US010105021B1

(12) United States Patent
McGuire

(10) Patent No.: US 10,105,021 B1
(45) Date of Patent: Oct. 23, 2018

(54) INFLATABLE TOILET SEAT ADAPTER FOR CHILD

(71) Applicant: Michael McGuire, Orlando, FL (US)

(72) Inventor: Michael McGuire, Orlando, FL (US)

( * ) Notice: Subject to any disclaimer, the term of this patent is extended or adjusted under 35 U.S.C. 154(b) by 0 days.

(21) Appl. No.: 15/624,840

(22) Filed: Jun. 16, 2017

(51) Int. Cl.
*A47K 13/00* (2006.01)
*A47K 13/02* (2006.01)

(52) U.S. Cl.
CPC ..... *A47K 13/005* (2013.01); *A47K 13/02* (2013.01)

(58) Field of Classification Search
CPC ..... A47K 13/005; A47K 13/02
USPC ..... 4/239
See application file for complete search history.

(56) References Cited

U.S. PATENT DOCUMENTS 2,767,408 A * 10/1956 Reibman ..... A47K 13/06 297/452.11
3,153,248 A * 10/1964 Miller ..... A47K 13/06 4/239
4,687,452 A * 8/1987 Hull ..... A47C 4/54 114/345

* cited by examiner

*Primary Examiner* — Lauren Crane

(57) ABSTRACT

A toilet seat adapter for use by infants and children who are unable to use conventional bathroom facilities. The invention includes a tubular inflatable plastic body, with a tubular seat portion having a front segment, side segments and rear segment that join to define a central opening. Connecting with a bottom side of seat portion side segments and seat portion rear segment is a downward extending tubular positioning ring. Sidewalls of the positioning ring are formed with respective sets of vertical, spaced apart stiffening ribs. Connecting respectively to the seat portion side segments is a pair of handles. Attached to the seat portion rear segment is an upstanding, tubular backrest while a flap covers the inflation device.

4 Claims, 5 Drawing Sheets

INFLATABLE TOILET SEAT ADAPTER FOR CHILD

BACKGROUND OF THE INVENTION

Field of the Invention

This invention relates generally to portable toilet seat adapters, and more particularly to a highly advantageous, differentially inflatable toilet seat adapter for toddlers that can be rapidly set up for use, and subsequently rapidly deflated and collapsed, for example to small size kit form.

Prior Art

There is need for portable toilet seat adapters for toddlers, especially for example on family outings and traveling. Prior devices of this nature were clumsy, complex, and lacked the many advantages of the present inflatable potty seat, including extreme collapsibility to compact kit size, very rapid inflatability for use during emergencies, and differential inflatability to resist reduction in size of the central well.

Inflatable toilets, bedpans, and toilet seat adapters are well-known and have been in use for many years but none has the features described in the present invention.

The toilet seat adapter of the present invention provides several advantages over like adapters presently known or in use.

A first advantage is that this adapter, when not in use, can be easily deflated and then folded for ready insertion into a small-size zip-lock type bag.

Secondly, this adapter can be fitted on conventional toilet seats having different size openings. The adapter positioning ring is sufficiently pliable to fit into different size toilet seat openings and then sufficiently rigid to hold the adapter in place. This rigidity is enhanced by the spaced apart, positioning ring laterally connected stiffening ribs. Once in use, the weight of a child increases the internal air pressure to provide still further stiffening of the positioning ring.

Further, the backrest of the adapter offers important support and stability for a child of toilet-training age. Such children are not always ready to execute when first placed on the adapter. The also spaced apart, laterally connected stiffening ribs in the adapter backrest insure that the backrest provides full height support. Another significant improvement on all existing inventions is that the present invention has an apparatus that blocks the sensors on auto flush devices.

SUMMARY OF THE INVENTION

A toilet seat adapter of this invention is particularly adapted for use by a child too small to use the seat of a conventional toilet. This adapter has an inflatable body made of a vinyl-like material. The adapter includes a tubular seat portion having a front segment, side segments and a rear segment that connect to define a central opening. Connected to a bottom side of the seat portion side segments and seat portion rear segment is a downward extending U-like shaped positioning ring. Inner and outer sidewalls of the positioning ring include respective sets of vertical, spaced apart stiffening ribs that are connected by lateral partitions. Connecting respectively to the seat portion side segments is a pair of handles. Attached to the seat portion rear segment is an upstanding, tubular backrest also formed with spaced apart, front and rear vertical stiffening ribs connected by lateral partitions.

In order to start using it, a deflated adapter is first inflated by blowing air into the adapter body through an air valve. Respective inner spaces of the seat portion, positioning ring, and backrest are operatively connected allowing inflowing air to uniformly inflate these elements and form a rigid structure. The adapter then is placed onto a conventional toilet seat. As seated, the adapter seat portions interact with the toilet seat and the adapter positioning ring fits snugly against sides of the toilet seat opening. As positioned, the adapter seat portion opening remains firmly aligned with the toilet seat opening when a child is seated on the adapter. For storage or during travel the adapter may be unsealed and deflated.

DESCRIPTION OF THE DRAWING FIGURES

DESCRIPTION OF THE PREFERRED EMBODIMENT

Figure 1:
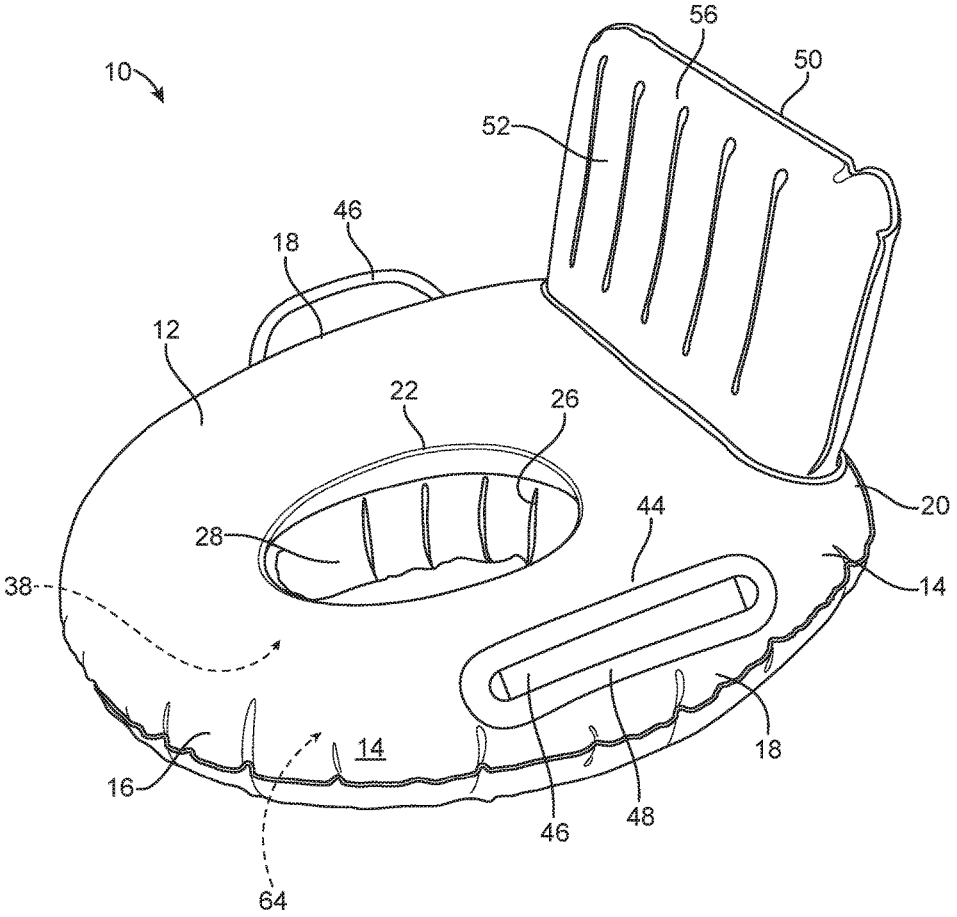
FIG. 1 is a perspective view of the toilet seat adapter of this invention.
Figure 2:
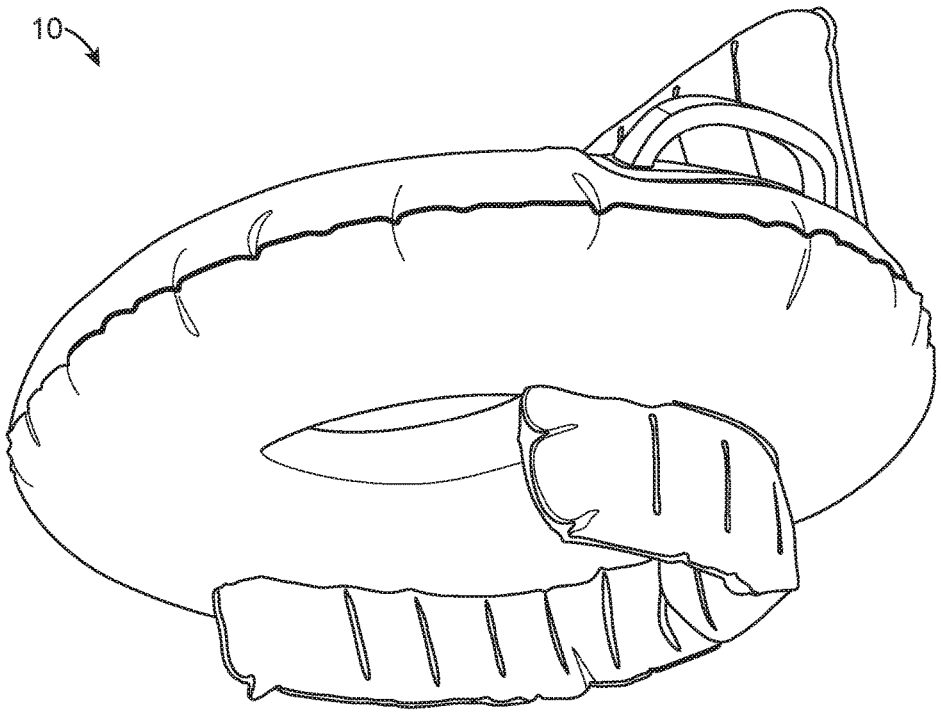
FIG. 2 is a bottom perspective view of FIG. 1.
Figure 3:
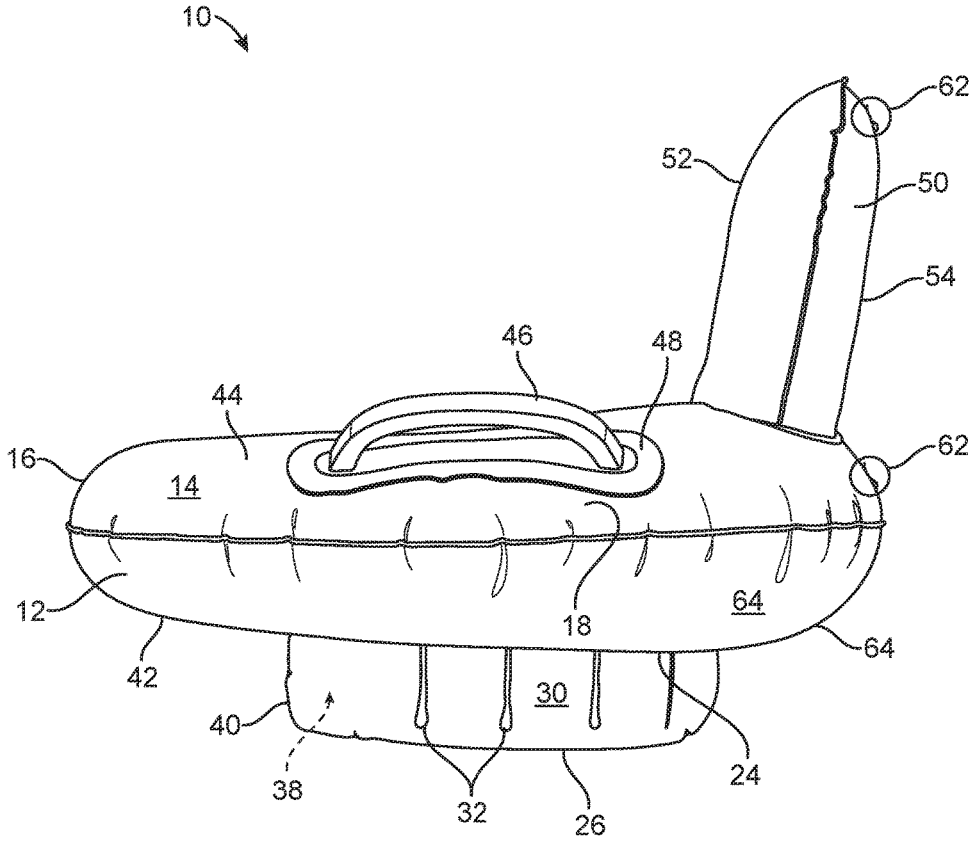
FIG. 3 is a side elevation view of the adapter of FIG. 1.
Figure 4:
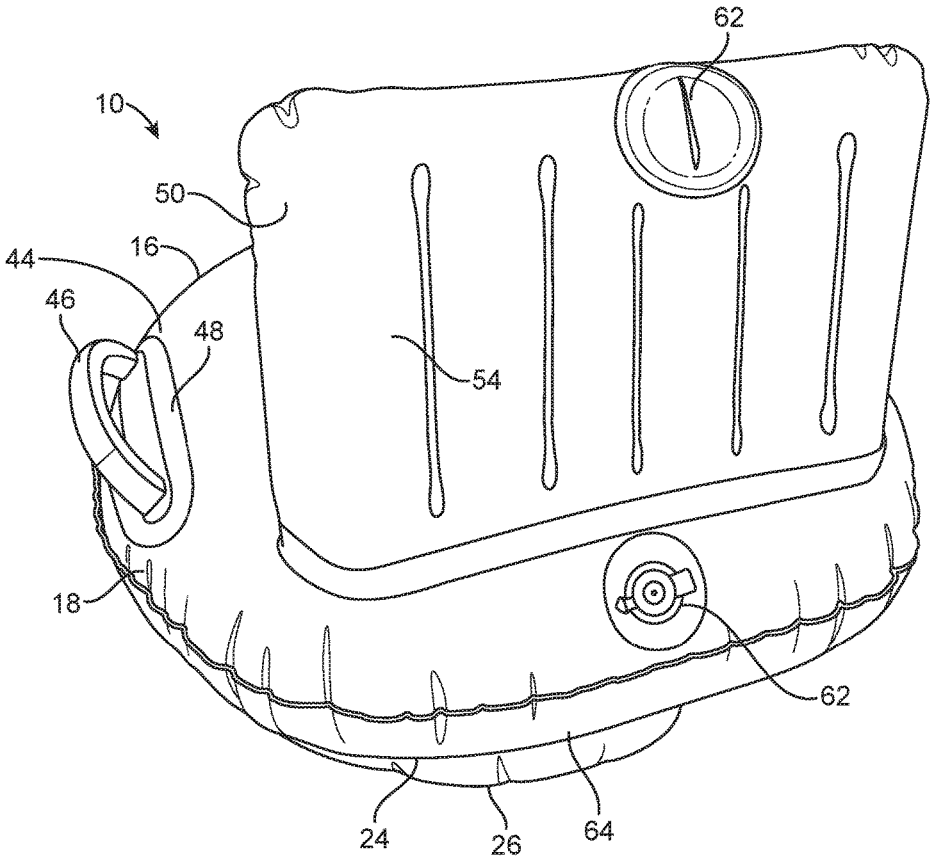
FIG. 4 is rear view of the adapter showing the flaps covering the valve.

A toilet seat adapter particularly adapted for use by a child too small to be supported comfortably by a toilet seat of a conventional toilet is shown generally in FIGS. 1,2 and 3 and designated 10 and FIG. 4.

The adapter 10 has an inflatable body 12 made of a soft, impermeable plastic material, such as from a vinyl sheet. This body 12 includes a tubular seat portion 14 having an arcuate-shaped front segment 16, side segments 18, and an arcuate-shaped rear segment 20. These segments 16-20 connect to define an inner oval-like shaped central opening 22.

Figure 5:
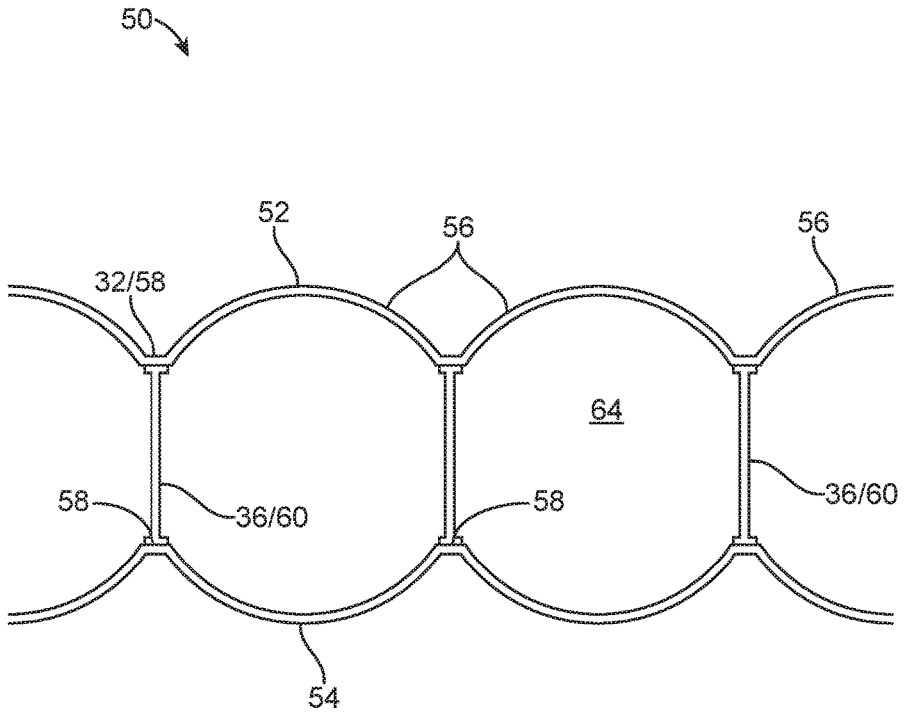
FIG. 5 is a cross-sectional view of a portion of the adapter positioning ring and backrest as seen generally alone the line 3-3 of FIGS. 1 and 3.

Connecting with a bottom side 24 of the seat portion side segments 18 and seat portion rear segment 20 is a downward extending, tubular, U-shaped positioning ring 26. Inner and outer sidewalls 28, 30 of the positioning ring 26 are formed with respective sets of vertical, spaced apart stiffening ribs 32 shown typically in FIG. 5. Oppositely positioned ribs 32 then are connected by lateral partitions 34. As the ring 26 is positioned, an open space 38 is formed between outer ends 40 of the positioning ring 26 and a bottom side 42 of the seat portion front segment 16.

Connected to respective upper sidewalls 44 of the seat portion side segments 18 is a pair of handles 46 that respectively project upwardly and outwardly. Ends of the handles 46 merge respectively with reinforcing plates 48 that arc welded to upper sidewalls 44 of the seat portion side segments 18.

Attached to a top wall 49 of the seat portion rear segment 20 is an upstanding, tubular backrest 50. This backrest 50 comprises a front and rear wall 52, 54 that are formed having sets of vertical, arcuate-shaped pleats 56 spaced apart by further stiffening ribs 32, see FIG. 5. Again, note that opposing backrest ribs 32 are connected by respective lateral partitions 34.

For use, a deflated adapter 10 first is unfolded and then inflated by blowing air into the adapter tubular body 12 through a commercially available, sealable air valve 62 carried by the rear wall 54 of the backrest 50. Air valve 62 is covered with flaps, see FIG. 4. Respective inner spaces 64 of the seat portion 14, the positioning ring 26, and the backrest 50 are operatively connected allowing inflowing air to uniformly inflate these elements 14, 26, 50 and form a rigid adapter structure.

The adapter 10 then is placed onto the seat of a conventional toilet such that the outer wall 30 of the positioning ring 26 fits against the sides of the conventional toilet seat opening and the bottom sides 24, 42 of the adapter seat portion segments 16, 18, and 20 rest on the toilet seat. The positioning ring 26 is sufficiently pliable to first deform and then fit snugly against sides of varying toilet seat opening configurations. Additionally, the ring 26 is sufficiently rigid that the adapter seat portion opening 22 remains aligned with the convention toilet seat opening when a child is seated on the adapter seat portion 14. Note that additional stability is added when a child sits on the adapter 10 resulting in further compression of air in the adapter 10. As seated, the child may grip the handles 46 to enhance a feeling of stability and lean back to be supported by the backrest 50.

When the adapter 10 is to be stored or taken for use during travel, for example, the valve 62 may be unsealed and air in the adapter 10 expelled by compressing the adapter body 12. The adapter body 12 then may be folded and placed in a small zip-lock type bag until use of the adapter 10 again is required.

While the embodiment, uses and advantages of this invention have been shown and discussed, it should be understood that this invention is limited only by the scope of the claims. Those skilled in the art will appreciate that various modifications and changes may be made without departing from the scope and spirit of the invention, and those modifications and changes may result in further uses and advantages.

REFERENCE NUMBER LISTING

10—adapter
12—inflatable body
14—tubular seat portion
16—front segment
18—side segments
20—rear segment
22—central opening
24—bottom side
26—positioning ring
28—
30—inner/outer sidewalls
32—stiffening ribs
34—partition
36—
38—open space
40—outer ends
42—bottom side of 16
44—upper sidewalls of 18
46—handles
48—reinforcing plate
49—top wall of 20
50—backrest
52—
54—front/rear side walls (Backrest)
56—pleats
58—
60—
62—air valve
64—inner space

I claim:

1. A toilet set adapter particularly adapted for use by a toddler, said adapter comprising a pliable inflatable body with said body including, a tubular seat portion having arcuate-shaped front and rear segments joined by side segments to define a central opening, a U-like shaped positioning ring attached to bottom sides of said side and rear seat portion segments to define an open space between outer ends of said positioning ring and a bottom side of seat portion front segment, a backrest attached to a top wall of seat portion rear segment, said backrest defined by a front and rear wall having pleats spaced apart by stiffening ribs, a pair of handles attached one each respectively to sidewalls of seat portion side segments, and an air valve operatively attached to said adapter body covered with flaps, wherein for use, air may be blown into said adapter body through said air valve to rigidify said body and allow said adapter positioning ring to form a compressive fit into different size toilet seat openings so that said child may seat securely on said adapter.

2. A toilet seat adapter as defined by claim 1, said adapter further comprising, reinforcing plates welded one each respectively to seat portion side segment upper side walls to interface with ends of said
handles.

3. A toilet seat adapter as defined by claim 1, said adapter further comprising, said positioning ring having an inner and outer sidewall formed with spaced apart stiffening ribs with oppositely positioned ribs connected by lateral partitions, wherein said ribs and said partitions are sufficiently flexible to promote installation of said adapter while enhancing maintenance of a position of said adapter once installed.

4. A toilet seat adapter as defined by claim 1, said adapter further comprising, said backrest having a front and rear wall formed respectively with a set of pleats spaced apart by stiffening ribs with oppositely positioned ribs connected by lateral partitions, wherein said ribs and said partitions enhance said backrest for full height back support of a child seated on said adapter.

* * * * *